US007884695B2

(12) United States Patent
Mosley et al.

(10) Patent No.: US 7,884,695 B2
(45) Date of Patent: Feb. 8, 2011

(54) LOW RESISTANCE INDUCTORS, METHODS OF ASSEMBLING SAME, AND SYSTEMS CONTAINING SAME

(75) Inventors: Larry E. Mosley, Santa Clara, CA (US); Clive R. Hendricks, Gilbert, AZ (US)

(73) Assignee: Intel Corporation, Santa Clara, CA (US)

( * ) Notice: Subject to any disclaimer, the term of this patent is extended or adjusted under 35 U.S.C. 154(b) by 1035 days.

(21) Appl. No.: 11/428,307

(22) Filed: Jun. 30, 2006

(65) Prior Publication Data

US 2008/0048813 A1 Feb. 28, 2008

(51) Int. Cl.
*H01F 5/00* (2006.01)

(52) U.S. Cl. ..... 336/200; 336/223

(58) Field of Classification Search ..... 336/65, 336/200, 223

See application file for complete search history.

(56) References Cited

U.S. PATENT DOCUMENTS

| | | | | |
|---|---|---|---|---|
| 3,765,082 | A * | 10/1973 | Zyetz | 29/602.1 |
| 4,689,594 | A * | 8/1987 | Kawabata et al. | 336/200 |
| 5,446,311 | A * | 8/1995 | Ewen et al. | 257/531 |
| 6,262,877 | B1 | 7/2001 | Mosley | |
| 6,362,716 | B1 * | 3/2002 | Anbo et al. | 336/200 |
| 6,631,540 | B2 | 10/2003 | Mosley | |
| 2006/0119391 | A1 * | 6/2006 | Sutardja | 326/82 |

* cited by examiner

*Primary Examiner*—Anh T Mai
*Assistant Examiner*—Joselito Baisa
(74) *Attorney, Agent, or Firm*—John N. Greaves

(57) ABSTRACT

A low-resistance inductor is made from a plurality of first inter-abutting insulated electrode coil sub-segments that is coupled to a plurality of second intra-abutting insulated electrode coil sub-segments that are contiguous to the plurality of first intra-abutting coil sub-segments. The first plurality and the second plurality form an helical inductor unit cell. A process of forming the low-resistance inductor includes heat curing. A system includes a low-resistance inductor and a mounting substrate.

27 Claims, 7 Drawing Sheets

LOW RESISTANCE INDUCTORS, METHODS OF ASSEMBLING SAME, AND SYSTEMS CONTAINING SAME

TECHNICAL FIELD

Embodiments relate generally to integrated circuit fabrication. More particularly, embodiments relate to component fabrication of inductors.

TECHNICAL BACKGROUND

Components are an important part of a packaged integrated circuit (IC) die. Inductors, resistors, and capacitors are often mounted with an IC die for signal and power regulation. Inductors can experience significant resistance even though the specific inductance is required for a given performance.

BRIEF DESCRIPTION OF THE DRAWINGS

In order to depict the manner in which the embodiments are obtained, a more particular description of embodiments briefly described above will be rendered by reference to specific embodiments that are illustrated in the appended drawings. Understanding that these drawings depict only typical embodiments that are not necessarily drawn to scale and are not therefore to be considered to be limiting of its scope, the embodiments will be described and explained with additional specificity and detail through the use of the accompanying drawings in which.

DETAILED DESCRIPTION

Embodiments in this disclosure relate to a low-resistance inductor component that is used in an integrated circuit (IC) package. Embodiments also relate to processes of forming low-resistance inductors.

The following description includes terms, such as upper, lower, first, second, etc., that are used for descriptive purposes only and are not to be construed as limiting. The embodiments of a device or article described herein can be manufactured, used, or shipped in a number of positions and orientations. The terms "die" and "chip" generally refer to the physical object that is the basic workpiece that is transformed by various process operations into the desired integrated circuit device. A die is usually singulated from a wafer, and wafers may be made of semiconducting, non-semiconducting, or combinations of semiconducting and non-semiconducting materials. A board is typically a resin-impregnated fiberglass structure that acts as a mounting substrate for the die.

Figure 1:
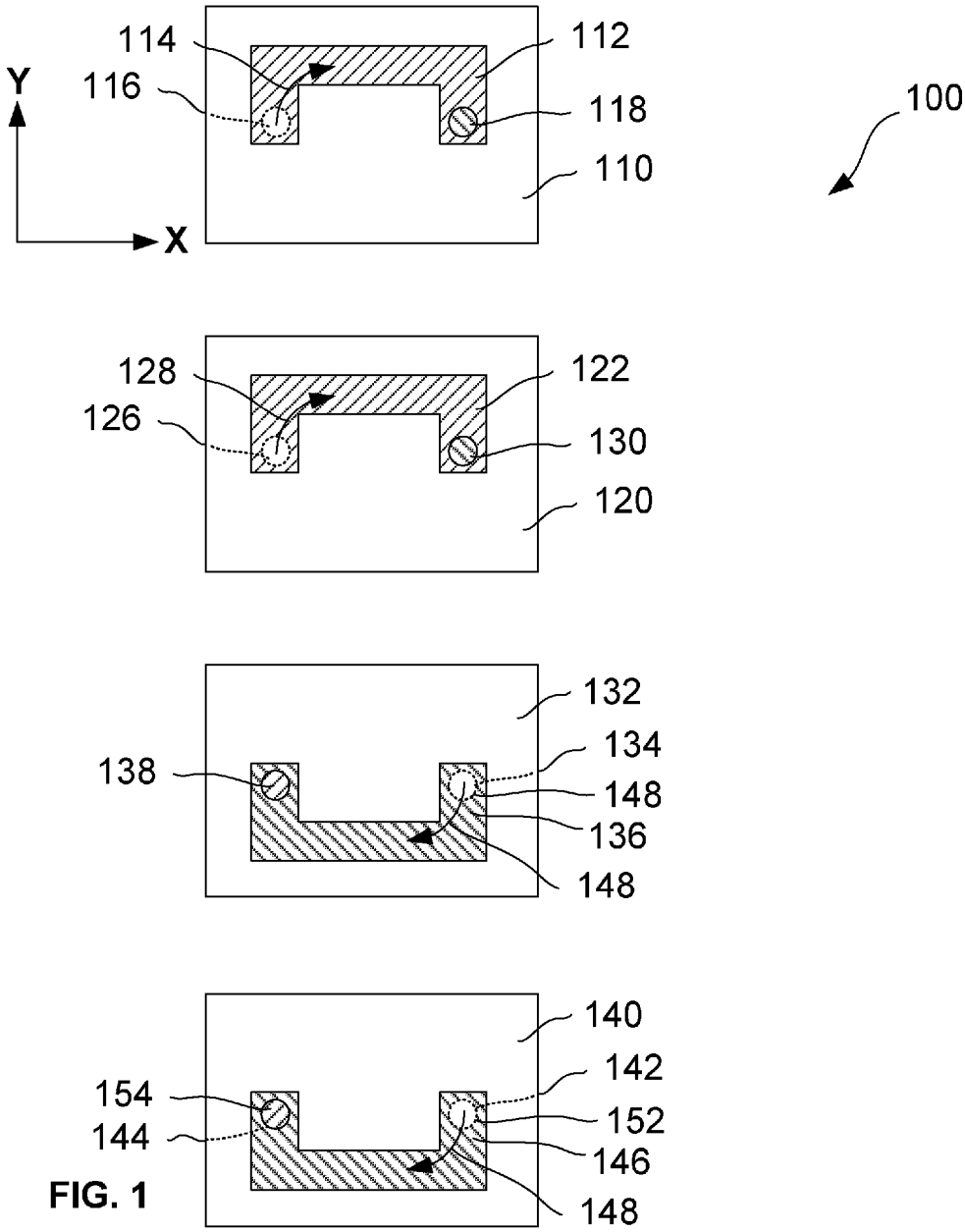
FIG. 1 is a top exploded plan of a low-resistance inductor unit cell according to an embodiment.

FIG. 1 is a top exploded plan of a low-resistance inductor 100 unit cell according to an embodiment. The unit cell includes the inductor electrodes. A dielectric (also referred to as magnetic) first film 110 is provided for convenience and insulation. In an embodiment, the first film 110 is made of a high permeability material such as Manganese Zinc Ferrite or Nickel Zinc Ferrite or other high permeability materials. In an embodiment, the dielectric is made from a Low K LTCC (low temperature co-fired ceramic) dielectric for use in high frequency applications (greater than 500 MHz).

The dielectric first film 110 supports an overhand arcuate inductor first section 112 (OAF). The "overhand" configuration is given with respect to the orientation of the FIG. In a process embodiment, the OAF 112 is patterned in a process such as screen printing or template printing. In an embodiment, the OAF 112 is made of a metal that contains copper. In an embodiment, the OAF 112 is made of a metal that contains silver. In an embodiment, the OAF 112 as well as all the electrodes, are fired with the ceramic materials, in a non-reactive environment to resist oxidation of the electrodes. In an embodiment, the OAF 112 is made of a metal that contains silver. In an embodiment, the OAF 112 is made of a metal that contains a copper-silver alloy. In an embodiment, the OAF 112 is made of a metal that contains aluminum. In an embodiment, the OAF 112 is made of a metal that contains a combination of any of the above metals.

Electrical current 114 in the OAF 112 is illustrated with a directional arrow for one possible current-flow direction. The OAF 112 includes a via 116, which in the illustrated embodiment is not used because it is represented as a first structure that is at a boundary of an inductor embodiment. The OAF 112 also includes an OAF via land 118, which is used to make an electrical coupling to a subsequent overhand arcuate first inductor section that is disclosed below.

Figure 2:
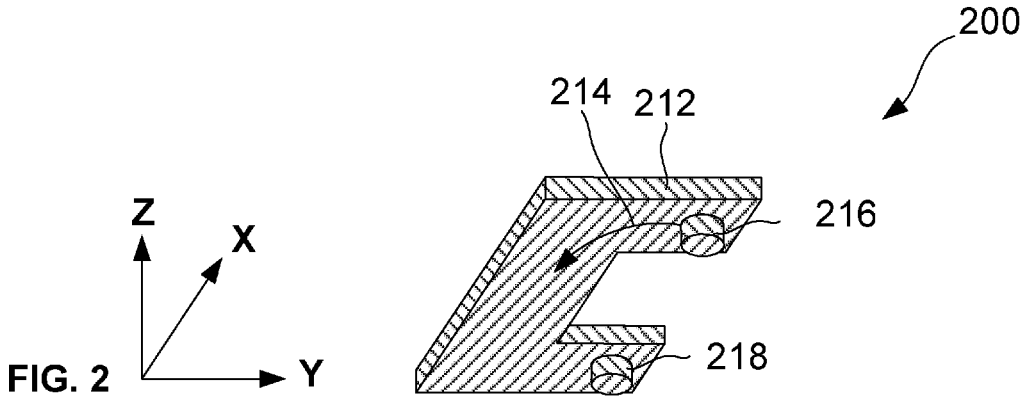
FIG. 2 is a perspective of an inductor subsection according to an embodiment.

FIG. 2 is a perspective of an inductor subsection 200 according to an embodiment. The inductor subsection 200 includes an arcuate inductor section 212 that is equivalent in structure to the OAF 112 depicted in FIG. 1. The X-Y-Z coordinates depicted in FIG. 2 can be mapped to the X-Y coordinates in FIG. 1, with the Z-coordinate in FIG. 1 being perpendicular to the plane of FIG. 1. The arcuate inductor section 212 illustrates a current 214 flow with a directional arrow for one possible current-flow direction. The arcuate inductor section 212 includes a filled via 216 and 218, which make electrical contact to an abutting and contiguous inductor section as is further illustrated herein. In other illustrated embodiments, only one occurrence of a filled via are provided for a given arcuate inductor section as is illustrated further in FIG. 7.

Reference is made again to FIG. 1. A dielectric subsequent film 120 is provided for insulation between the OAF 112 and an overhand arcuate subsequent inductor section 122 (OAS). The "overhand" configuration is given with respect to the orientation of the FIG. In an embodiment, the dielectric subsequent film 120 is made of a high permeability material such as any of the high-permeability materials set forth in this disclosure and their equivalents.

A plurality of vias (not shown on the drawing) and 126 is also depicted for electrical contact between the abutting arcuate inductor sections; the OAF 112 and the OAS 122. In an embodiment, the plurality of vias 124 and 126 provides electrical coupling between spaced-apart arcuate inductor sections.

In a process embodiment, the OAS 122 is patterned in a process such as screen printing or template printing. In an embodiment, the OAS 122 is made of a metal. The OAS 122 can be made of any metal embodiment disclosed herein. In an embodiment, the OAS 122 is made of the same metal that is contained in the OAF 112. In an embodiment, the OAS 122 is of a subsequent thickness, the OAS 112 is of a first thickness, and the first thickness is different from the subsequent thickness. In an embodiment, the OAS 122 and the OAF 112 are made of different metals. In an embodiment, the OAS 122 is of a subsequent thickness, the OAF 112 is of a first thickness, the first thickness is different from the subsequent thickness, and the OAS 122 and the OAF 112 are made of different metals.

Electrical current 128 in the OAS 122 is illustrated with a directional arrow for one possible current-flow direction. The via 126 is illustrated in phantom lines since it is below the plane of the FIG. The via 126 is a filled via such as the filled via 216 that is illustrated in FIG. 2. The via 126 penetrates the dielectric subsequent film 120 for electrical contact with the OAF 112 at the site of the via 116, but contact occurs at the exposed surface. The OAS 122 also includes an OAS via land 130, which is used to make an electrical coupling to an inductor section that is disclosed below. In an embodiment, the OAS 122 also includes a filled via below the OAS via land 130, which is used to make an electrical contact downwardly to the OAF 112 at the site of the OAF via land 118.

Next, a dielectric film 132 is laminated above and on the dielectric subsequent film 120 and the OAS 122. In an embodiment, the dielectric film 132 is a dielectric material that has a high permeability such as at least one of the high permeability materials set forth in this disclosure. A via 134 is also depicted for electrical contact between abutting arcuate inductor sections.

The-film 132 supports an underhand arcuate inductor first section 136 (UAF) that is disposed upon a dielectric film 132. The "underhand" configuration is given with respect to the orientation of the FIG. In a process embodiment, the UAF 136 is patterned in a process such as screen printing or template printing. In an embodiment, the UAF 136 is made of a metal. The UAF 136 can be made of any metal embodiment disclosed herein. In an embodiment, the UAF 136 is made of the same metal that is contained in the overhand section of the inductor.

Electrical current 138 in the UAF 136 is illustrated with a directional arrow for one possible current-flow direction. The UAF 136 includes the via 134, which in the illustrated embodiment is delineated in phantom lines since it is below the plane of the FIG. The via 134 is a filled via such as the filled via 216 that is illustrated in FIG. 2. The UAF 136 also includes an UAF via land 138, which is used to make an electrical coupling to a subsequent inductor section that is disclosed below. Patterning of via lands is in an opposite cross-hatch for delineation purposes.

Next, a dielectric film 140 for the UAF 136 is laminated above and on the dielectric film 132 and the UAF 136. In an embodiment, the dielectric film 140 for the UAF 136 is a dielectric material that has a high permeability such as at least one of the high permeability materials set forth in this disclosure. A plurality of vias 142 and 144 is also depicted for electrical contact between abutting arcuate inductor sections. In an embodiment, the plurality of vias 142 and 144 provides electrical coupling between spaced-apart arcuate inductor sections.

The film 140 supports an underhand arcuate inductor subsequent section 146 (UAS). The "underhand" configuration is given with respect to the orientation of the FIG. In a process embodiment, the UAS 146 is patterned in a process such as screen printing or template printing. In an embodiment, the UAS 146 is made of a metal. The UAS 146 can be made of any metal embodiment disclosed herein. In an embodiment, the UAS 146 is made of the same metal that is contained in the overhand section of the inductor.

Electrical current 148 in the UAS 146 is illustrated with a directional arrow for one possible current-flow direction. The UAS 146 includes the plurality of vias 142 and 144, which in the illustrated embodiment is depicted with dashed lead lines because they are below the plane of the FIG. The plurality of vias 142 and 144 are filled vias such as the filled vias 216 and 218 that are illustrate in FIG. 2. The UAS 146 also includes UAS via lands 152 and 154, which can be used to make an electrical coupling to a subsequent inductor section in an embodiment. Patterning of the via land 152 is in an opposite cross-hatch than the UAS 146 for delineation purposes.

Figure 3:
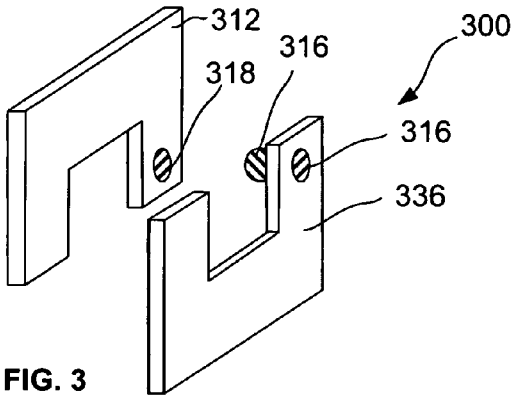
FIG. 3 is an exploded perspective of a portion of a low-resistance inductor according to an embodiment.

FIG. 3 is an exploded perspective of a portion of a low-resistance inductor 300 according to an embodiment. In an embodiment, the structure depicted is one half of an inductor embodiment. An OAF 312 is depicted to be aligned at an OAF via land 318, to a UAF 336 at a filled via 316. The filled via 316 is illustrated with two identical reference numerals. This is because an electrode screening process forms the UAF 336 and the filled via 316 as an integral unit, which is depicted as substructures for clarity. A dielectric or magnetic film would be placed between the OAF 312 and the UAF 336, but is not illustrated for clarity. By the same token, a dielectric film would be placed behind the OAF 312 and another dielectric or magnetic film would be placed in front of the UAF 336, but are not illustrated for clarity.

Figure 4:
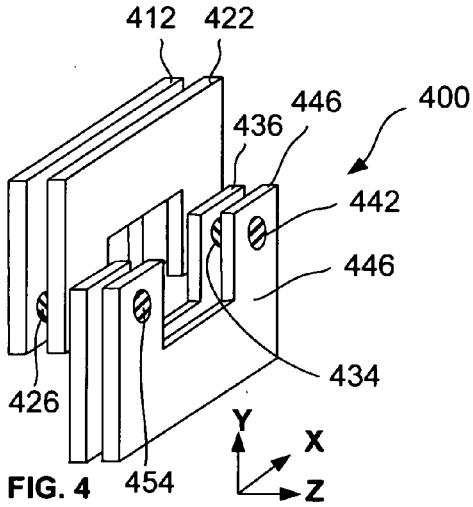
FIG. 4 is an exploded perspective of a low-resistance inductor unit cell according to an embodiment.

FIG. 4 is an exploded perspective of a low-resistance inductor unit cell 400 according to an embodiment. The X-Y-Z coordinates depicted in FIG. 4 can be mapped to the X-Y coordinates in FIG. 1, with the Z-coordinate in FIG. 1 being perpendicular to the plane of FIG. 1. The low-resistance inductor unit cell 400 includes a plurality of first inter-abutting insulated electrode coil sub-segments. An OAF 412 is depicted to be aligned at an OAF via land (obscured), to a UAF 436 at a filled via 434. An OAS 422 matches the OAF 412 in form factor, and includes vias and via lands that are obscured as illustrated. A UAS 446 is depicted in front of the unit cell 400 and includes a filled via 454 that is aligned with a visible via land 426 that is on the OAF 412. A filled via 442 on the UAS 446 is depicted and is aligned with a via land 434 that is visible on the UAF 436. A dielectric or magetic film is located between the OAF 412 and the OAS 422, but is not illustrated for clarity. The OAF 412 and the OAS 422 occupy the same profile in the X-Y space, but a different profile in the Z-dimension. A dielectric or magnetic film is also located between the OAS 422 and the UAF 436, but is not illustrated for clarity. A dielectric or magnetic film is also located between the UAF 436 and the UAS 446, but is not illustrated for clarity. By the same token, a dielectric or magnetic film is located behind the OAF 412 and another dielectric film or magnetic is located in front of the UAS 446, but are not illustrated for clarity. The UAF 436 and the UAS 446 occupy the same profile in the X-Y space, but a different profile in the Z-dimension. In this embodiment, the unit cell 400 includes a plurality of two contiguous overhand and two contiguous underhand inductor sections. The materials and thickness embodiments set forth for the structure depicted in FIG. 1 is also applicable to the unit cell 400 depicted in FIG. 4.

In an embodiment, the unit cell 400 is repeated once to produce an inductor article with two complete turns. In an embodiment, the unit cell 400 is trebled to produce an inductor article with three complete turns. In an embodiment, the unit cell 400 is repeated to produce an inductor article that has up to about 1,000 inductor sections, and in the plurality duplicate embodiment, that results in about 250 complete turns for the inductor article. Other complete turn numbers can be fabricated for a given application.

Figure 5:
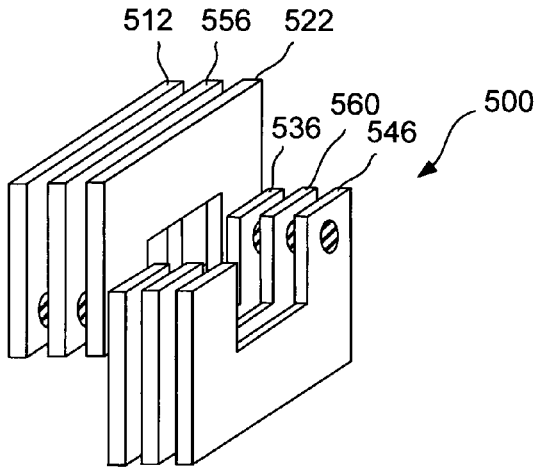
FIG. 5 is an exploded perspective of a low-resistance inductor unit cell according to an embodiment.

In an embodiment, the resistivity in the OAF is dissimilar to the resitivity of the OAS. Similarly, the resistivity in the UAF is dissimilar to the resitivity of the UAS. FIG. 5 is an exploded perspective of a low-resistance inductor unit cell 500 according to an embodiment. In this embodiment, the unit cell 500 includes a plurality of three contiguous overhand and three contiguous underhand inductor sections. The unit cell 500 is an helical inductor unit cell 500. The structure is similar to the unit cell 400 depicted in FIG. 4. The unit cell 500 includes an OAF 512, an OAS 522, and therebetween an overhand arcuate inductor second section 556 (OA2). The unit cell similarly includes a UAF 536, a UAS 546, and therebetween an underhand arcuate inductor second section 560 (UA2). In general, an inductor section such as the OA2 556 or the UA2 560 can be referred to as an intermediate section; an overhand arcuate intermediate inductor section (OAI) 556 or a underhand arcuate intermediate inductor section (UAI) 560.

In an embodiment, the unit cell 500 is repeated once to produce an inductor article with two complete turns. In an embodiment, the unit cell 500 is trebled to produce an inductor article with three complete turns. In an embodiment, the unit cell 500 is repeated to produce an inductor article that has up to about 1,000 inductor sections, and in the plurality triplicate embodiment, that results in about 166 complete turns for the inductor article. In an embodiment, about 333 contiguous, serial unit cells are provided. In an embodiment, about 500 contiguous, serial unit cells are provided. Other complete turn numbers can be fabricated for a given application In an embodiment, three contiguous, serial unit cells are provided. In an embodiment, more than three contiguous, serial unit cells are provided.

Figure 6:
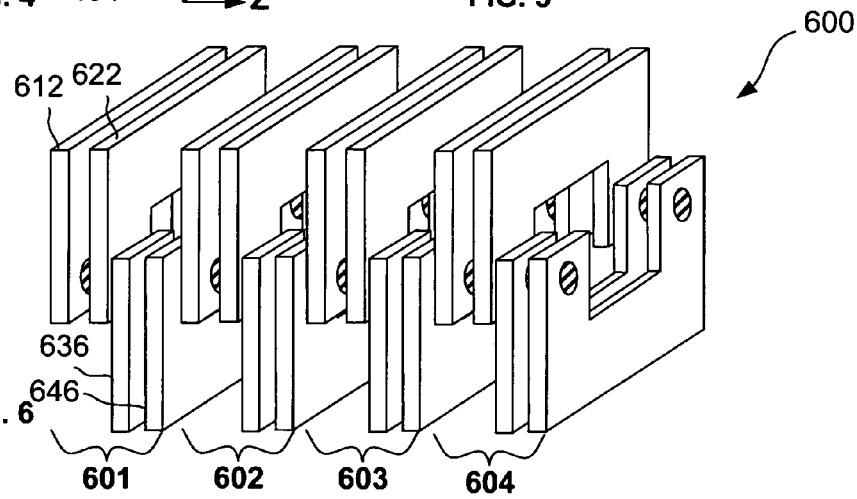
FIG. 6 is an exploded perspective of a low-resistance inductor with four unit cells according to an embodiment.

FIG. 6 is an exploded perspective of a low-resistance inductor 600 with four unit cells according to an embodiment. The low-resistance inductor 600 includes a plurality of two contiguous overhand and two contiguous underhand inductor sections, repeated three times for a total of four unit cells. A first unit cell 601 is illustrated with an OAF 612, an OAS 622, a UAF 636, and a UAS 646. The low-resistance inductor 600 also includes a second unit cell 602, a third unit cell 603, and a fourth unit cell 604.

Figure 7:
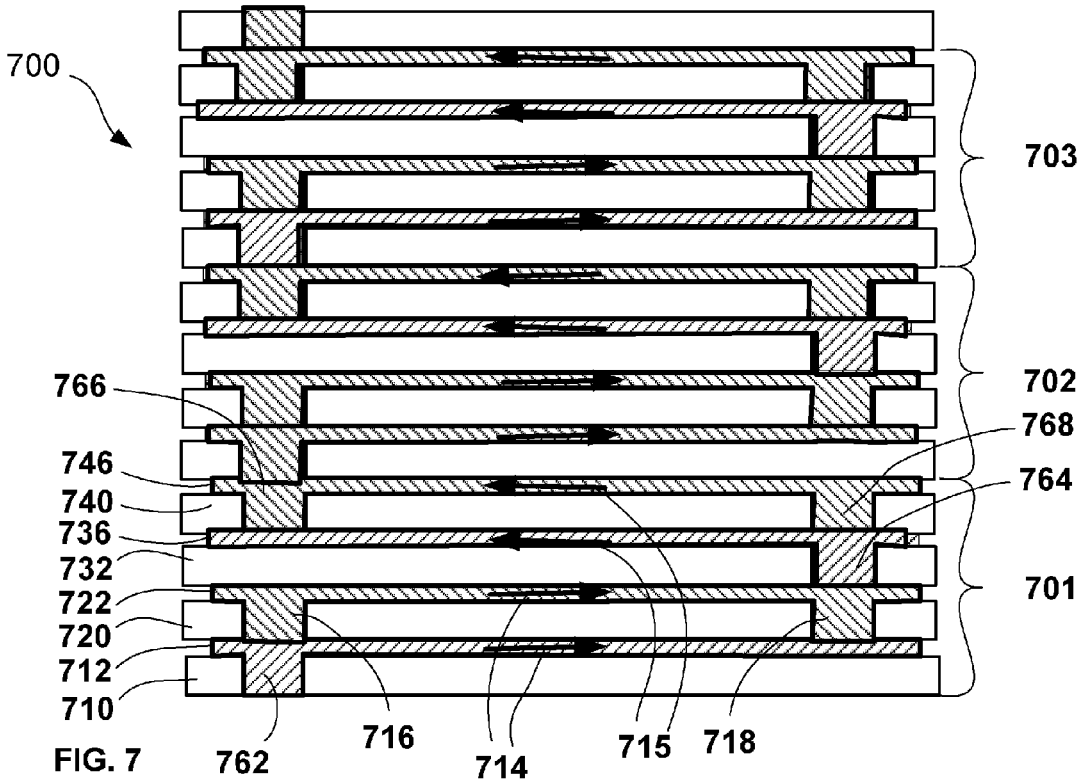
FIG. 7 is a cut-away elevation of an article that includes three unit cells of a low-resistance inductor according to an embodiment.

FIG. 7 is a cut-away elevation of an article that includes three unit cells of a low-resistance inductor 700 according to an embodiment. The low-resistance inductor 700 includes a first unit cell 701, a second unit cell 702, and a third unit cell 703.

The low-resistance inductor 700 first unit cell 701 includes an OAF 712, an OAS 722, a UAF 736, and a UAS 746. The OAF 712 is disposed upon an OAF dielectric 710. The OAS 722 is disposed upon an OAS dielectric 720. The UAF 736 is disposed upon a UAF dielectric 732. The UAS 746 is disposed upon a UAS dielectric 740.

Filled vias are also illustrated in FIG. 7. A pin-out via 762 penetrates the OAF dielectric 710 according to a pin-out embodiment. Other pin-out methods can be used that are known for inductor technology. A first via 716 and a second via 718 are depicted as being integral with the OAS 722 according to a screen or template printing process embodiment. In this embodiment, the first via 716 and the second via 718 penetrate the OAS dielectric 720 and are filled when the OAS 722 is formed. A connecting via 764 allows the UAF 736 to be abutting and electrically in contact with the OAS 722. "In contact" means the OAS 722 and the UAF 736 have nothing electrically therebetween except the connecting via 764. The OAF 712 and the UAF 736, on the other hand, are electrically coupled, but not "electrically in contact". A first via 766 and a second via 768 are depicted as being integral with the UAS 746 according to a screen or template printing process embodiment. In this embodiment, the first via 766 and the second via 768 penetrate the UAS dielectric 740 and are filled when the UAS 746 is formed.

Figure 8:
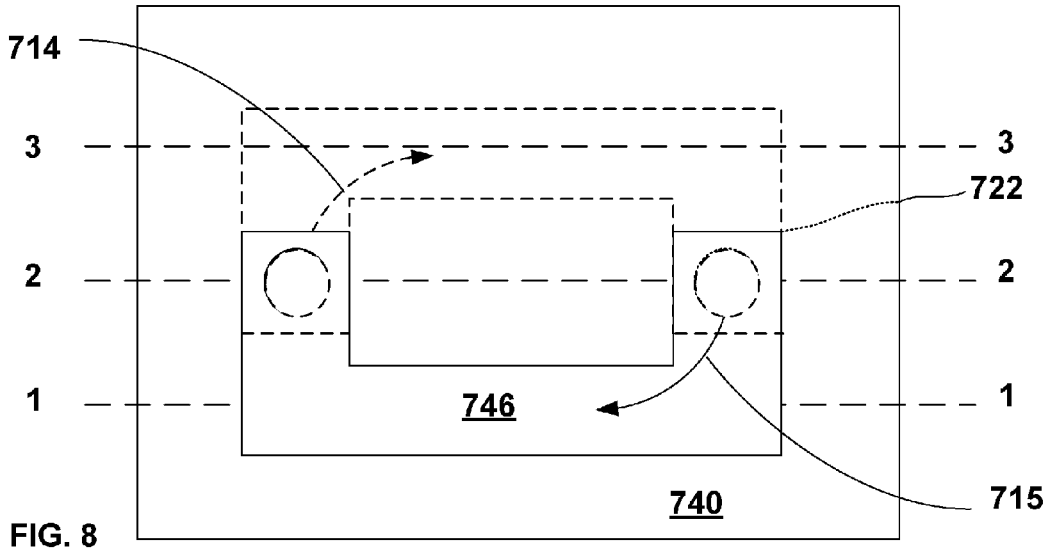
FIG. 8 is a cut-away top plan of a low-resistance inductor that illustrates locations of selected structures of the low-resistance inductor depicted in FIG. 7 according to an embodiment.

FIG. 8 is a cut-away top plan of a low-resistance inductor that illustrates locations of selected structures of the low-resistance inductor depicted in FIG. 7 according to an embodiment. The OAF 712 is depicted in phantom lines. The UAS dielectric 740 has been exposed, and the UAS 746 is depicted disposed upon the UAS dielectric 740. Electrical current 714 in the OAF 712 is illustrated with a directional arrow in phantom lines for a current-flow direction embodiment. Electrical current 715 in the UAS 746 is illustrated with a directional arrow for a current-flow direction embodiment.

The OAF 712 depicted in FIG. 7 is exposed when cutting along the dashed line 1 depicted in FIG. 8. The first via 716 and the second via 718 penetrate the OAS dielectric 720 and they are exposed when cutting along the dashed line 2 depicted in FIG. 8. The OAS 722 depicted in FIG. 7 is exposed when cutting along the dashed line 1 depicted in FIG. 8. The via 764 penetrates the UAF dielectric 732 and they are exposed when cutting along the dashed line 2 depicted in FIG. 8. The UAF 736 depicted in FIG. 7 is exposed when cutting along the dashed line 3 depicted in FIG. 8. The vias 766 and 768 penetrate the UAS dielectric 740 and they are exposed when cutting along the dashed line 2. The UAS 746 depicted in FIG. 7 is exposed when cutting along the dashed line 3 depicted in FIG. 8.

Figure 9:
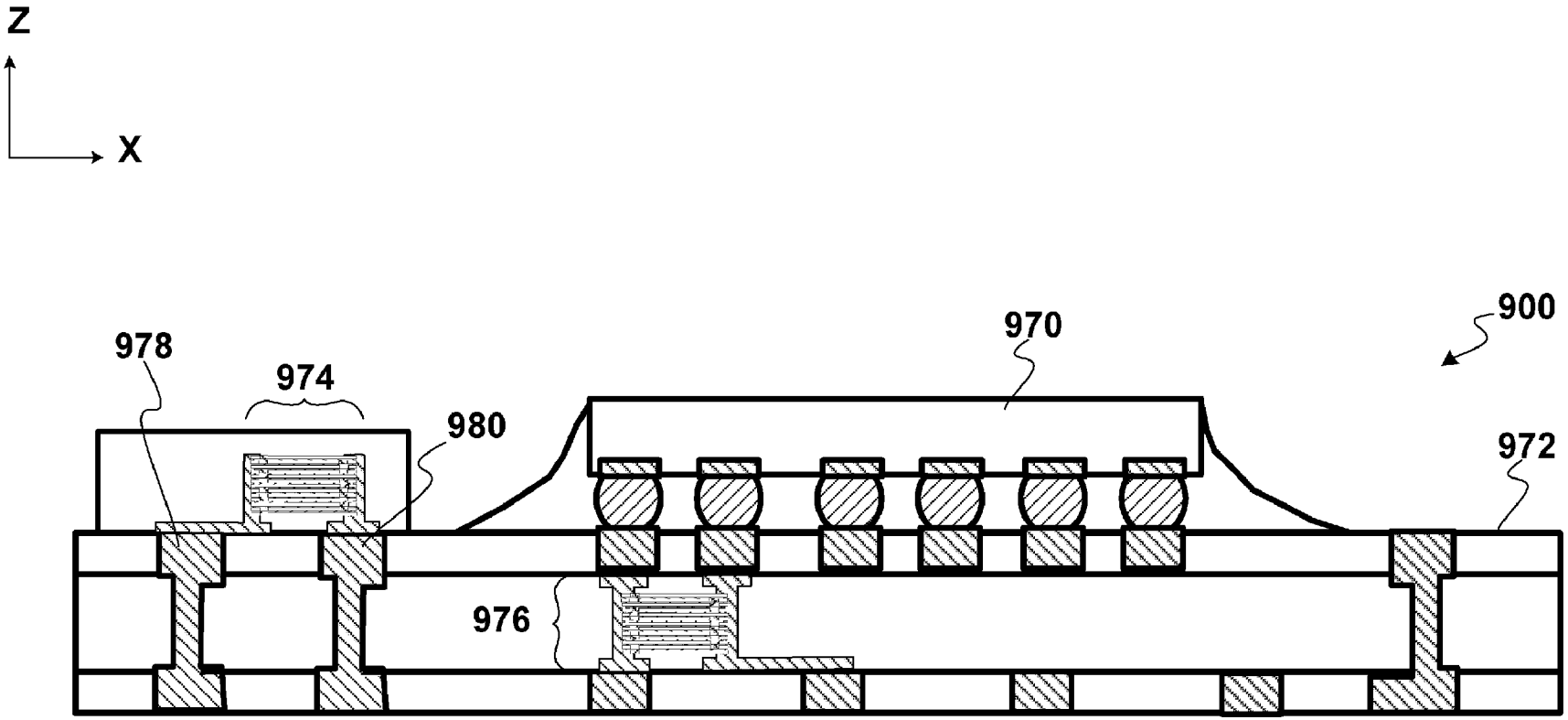
FIG. 9 is a cross-sectional elevation of a package that includes a low-resistance inductor according to an embodiment.

FIG. 9 is a cross-sectional elevation of a package 900 that includes a low-resistance inductor according to an embodiment. The package 900 includes a die 970 and a mounting substrate 972. Two occurrences of a low-resistance inductor 974, and 976 are depicted. In an embodiment, the low-resistance inductor 974 is disposed laterally to the die 970 and upon the mounting substrate 972. In an embodiment, the low-resistance inductor 976 is disposed below the die 970 and integral to the mounting substrate 972. In an embodiment, the die 970 is not present, but a die site occupies the same space on the mounting substrate 972 that a die can eventually occupy such as die 970, and the low-resistance inductor 976 is disposed below the die site and is integral to the mounting substrate 972.

The low-resistance inductor 974 that is disposed laterally to the die 970 is illustrated in greater detail. Further to the structure of the low-resistance inductor 974 are a first pin-out contact 978 that contacts one end of the low-resistance inductor 974, and a second pin-out contact 980 that contacts the second electrode.

Figure 10:
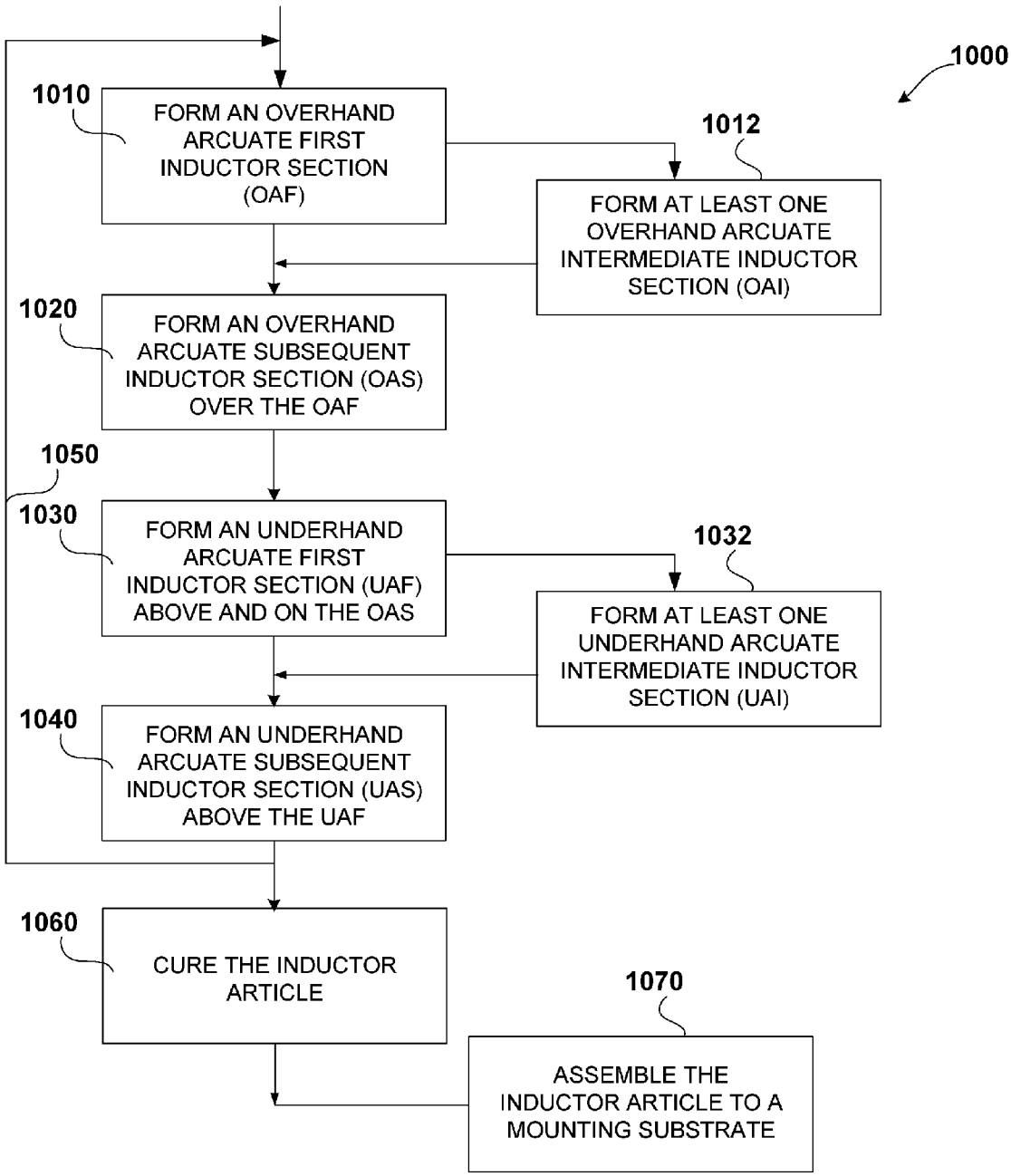
FIG. 10 is a process depiction of forming a low-resistance inductor according to an embodiment.

FIG. 10 is a process depiction 1000 of forming a low-resistance inductor according to an embodiment.

At 1010, the process includes forming an overhand arcuate inductor first section on a dielectric film.

At 1020, the process includes forming an overhand arcuate inductor subsequent section above the overhand arcuate inductor first section.

At 1012, the process includes forming at least one overhand arcuate inductor intermediate section between the overhand arcuate inductor first section and the overhand arcuate inductor subsequent section.

At 1030, the process includes forming an underhand arcuate inductor first section above and on the overhand arcuate inductor subsequent section.

At 1040, the process includes forming an underhand arcuate inductor subsequent section above the underhand arcuate inductor first section.

At 1032, the process includes forming at least one underhand arcuate inductor intermediate section between the underhand arcuate inductor first section and the underhand arcuate inductor subsequent section.

At 1050, the process includes repeating the selected processes at least once to form a number of inductor turns.

At 1060, the process includes curing the inductor article. In an embodiment, the process includes firing the inductor article to transform the dielectric or magnetic layers into a fired, high permeability ceramic.

At 1070, a method embodiment includes assembling the inductor article to a mounting substrate.

Figure 11:
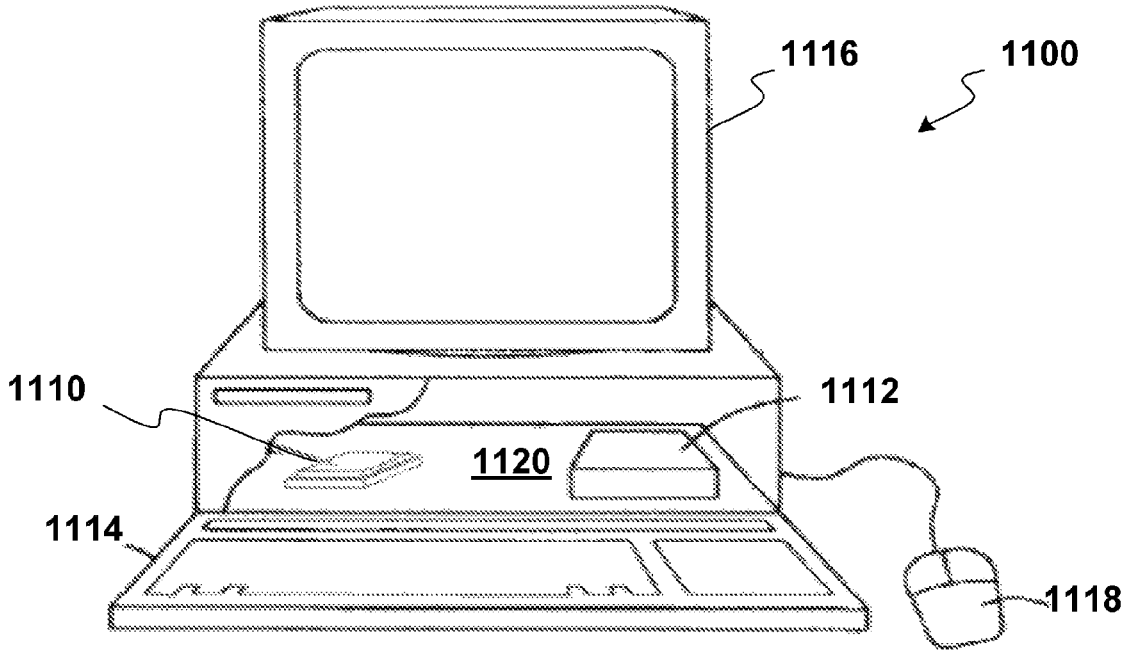
FIG. 11 is a cut-away perspective that depicts a computing system according to an embodiment.

FIG. 11 is a cut-away perspective that depicts a computing system 1100 according to an embodiment. One or more of the foregoing embodiments of the low-resistance inductor may be utilized in a computing system, such as a computing system 1100 of FIG. 11. Hereinafter, any low-resistance inductor embodiments alone, or in combination with any other embodiment, is referred to as an embodiment(s) configuration.

The computing system 1100 includes at least one processor (not pictured), which is enclosed in a package 1110, a data storage system 1112, at least one input device such as a keyboard 1114, and at least one output device such as a monitor 1116, for example. The computing system 1100 includes a processor that processes data signals, and may include, for example, a microprocessor, available from Intel Corporation. In addition to the keyboard 1114, the computing system 1100 can include another user input device such as a mouse 1118, for example.

For purposes of this disclosure, a computing system 1100 embodying components in accordance with the claimed subject matter may include any system that utilizes a microelectronic device system, which may include, for example, at least one low-resistance inductor embodiment that is coupled to data storage such as dynamic random access memory (DRAM), polymer memory, flash memory, and phase-change memory. In this embodiment, the embodiment(s) is coupled to any combination of these functionalities by being coupled to a processor. In an embodiment, however, an embodiment (s) configuration set forth in this disclosure is coupled to any of these functionalities. For an example embodiment, data storage includes an embedded DRAM cache on a die. Additionally, in an embodiment, the embodiment(s) configuration that is coupled to the processor (not pictured) is part of the system with an embodiment(s) configuration that is coupled to the data storage of the DRAM cache. Additionally, in an embodiment, an embodiment(s) configuration is coupled to the data storage 1112.

In an embodiment, the computing system 1100 can also include a die that contains a digital signal processor (DSP), a micro controller, an application specific integrated circuit (ASIC), or a microprocessor. In this embodiment, the embodiment(s) configuration is coupled to any combination of these functionalities by being coupled to a processor. For an example embodiment, a DSP (not pictured) is part of a chipset that may include a stand-alone processor and the DSP as separate parts of the chipset on the board 1120. In this embodiment, an embodiment(s) configuration is coupled to the DSP, and a separate embodiment(s) configuration may be present that is coupled to the processor in the package 1110. Additionally in an embodiment, an embodiment(s) configuration is coupled to a DSP that is mounted on the same board 1120 as the package 1110. It can now be appreciated that the embodiment(s) configuration can be combined as set forth with respect to the computing system 1100, in combination with an embodiment(s) configuration as set forth by the various embodiments of the low-resistance inductor within this disclosure and their equivalents.

Figure 12:
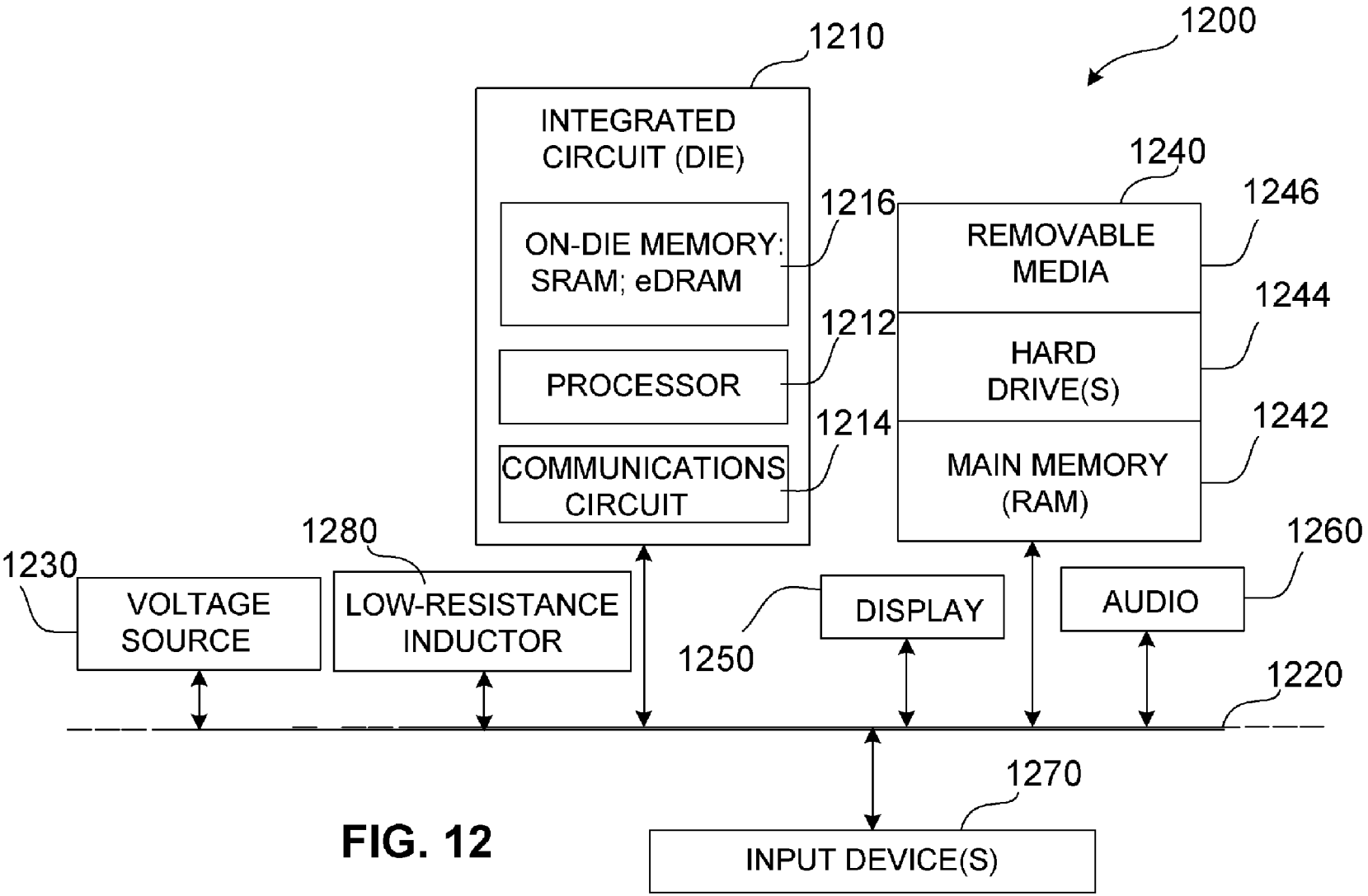
FIG. 12 is a schematic of an electronic system according to an embodiment.

FIG. 12 is a schematic of an electronic system 1200 according to an embodiment. The electronic system 1200 as depicted can embody the computing system 1100 depicted in FIG. 11, but the electronic system 1200 is depicted more generically. The electronic system 1200 incorporates at least one integrated circuit electronic assembly 1210, such as an IC package illustrated in FIGS. 3-6. In an embodiment, the electronic system 1200 is a computer system that includes a system bus 1220 to electrically couple the various components of the electronic system 1200. The system bus 1220 is a single bus or any combination of busses according to various embodiments. The electronic system 1200 includes a voltage source 1230 that provides power to the integrated circuit 1210. In some embodiments, the voltage source 1230 supplies current to the integrated circuit 1210 through the system bus 1220.

In an embodiment, a low-resistance inductor 1280 is electrically located between the voltage source 1230 and the integrated circuit 1210. Such location in an embodiment is in a mounting substrate and the low-resistance inductor 1280 is integral to the mounting substrate. Such location of the low-resistance inductor 1280 in an embodiment is upon a mounting substrate that provides a seat for the integrated circuit 1210 and the low-resistance inductor 1280, such as a processor and a low-resistance inductor component, each mounted laterally and adjacent to the other on a board.

The integrated circuit 1210 is electrically coupled to the system bus 1220 and includes any circuit, or combination of circuits, according to an embodiment. In an embodiment, the integrated circuit 1210 includes a processor 1212 that can be of any type. As used herein, the processor 1212 means any type of circuit such as, but not limited to, a microprocessor, a microcontroller, a graphics processor, a digital signal processor, or another processor. Other types of circuits that can be included in the integrated circuit 1210 are a custom circuit or an ASIC, such as a communications circuit 1214 for use in wireless devices such as cellular telephones, pagers, portable computers, two-way radios, and similar electronic systems. In an embodiment, the integrated circuit 1210 includes on-die memory 1216 such as SRAM. In an embodiment, the integrated circuit 1210 includes on-die memory 1216 such as embedded DRAM (eDRAM).

In an embodiment, the electronic system 1200 also includes an external memory 1240 that in turn may include one or more memory elements suitable to the particular application, such as a main memory 1242 in the form of RAM, one or more hard drives 1244, and/or one or more drives that handle removable media 1246 such as diskettes, compact disks (CDs), digital video disks (DVDs), flash memory keys, and other removable media known in the art.

In an embodiment, the electronic system 1200 also includes a display device 1250, and an audio output 1260. In an embodiment, the electronic system 1200 includes an input device controller 1270, such as a keyboard, mouse, trackball, game controller, microphone, voice-recognition device, or any other device that inputs information into the electronic system 1200.

As shown herein, integrated circuit 1210 can be implemented in a number of different embodiments, including an electronic package, an electronic system, a computer system, one or more methods of fabricating an integrated circuit, and one or more methods of fabricating an electronic assembly that includes the integrated circuit and the low-resistance inductor embodiments as set forth herein in the various embodiments and their art-recognized equivalents. The elements, materials, geometries, dimensions, and sequence of operations can all be varied to suit particular packaging requirements.

It can now be appreciated that low-resistance inductor embodiments set forth in this disclosure can be applied to devices and apparatuses other than a traditional computer. For example, a die can be packaged with an embodiment(s) configuration, and placed in a portable device such as a wireless communicator or a hand-held device such as a personal data assistant, and the like. In another example, a die can be packaged with an embodiment(s) configuration and placed in a vehicle such as an automobile, a locomotive, a watercraft, an aircraft, or a spacecraft.

The Abstract is provided to comply with 37 C.F.R. §1.72(b) requiring an abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

What is claimed is:

1. An inductor article comprising:

an overhand arcuate inductor first section (OAF);

an overhand arcuate inductor subsequent section (OAS) that is electrically coupled to the overhand arcuate inductor first section, wherein the OAF and the OAS occupy the same profile in the X-Y space, but a different profile in the Z-dimension and wherein the OAS is abutting and electrically in contact with the OAF;

an underhand arcuate inductor first section (UAF) that is abutting and electrically in contact with the OAS; and an underhand arcuate inductor subsequent section (UAS) that is electrically coupled to the UAF, wherein the UAF and the UAS occupy the same profile in the X-Y space, but a different profile in the Z-dimension, and wherein the UAF is abutting and electrically in contact with the UAS.

2. The inductor article of claim 1, wherein the OAF includes an OAF via land, the inductor article further including:

a dielectric film for the OAF disposed below the OAF.

3. The inductor article of claim 1, wherein the OAS includes an OAS via land, the inductor article further including:

a dielectric film for the OAS disposed between the OAF and the OAS, and wherein the dielectric film for the OAS includes a via that is aligned at the OAS via land.

4. The inductor article of claim 1, wherein the UAF includes a UAF via land, the inductor article further including:

a dielectric film for the UAF, wherein the dielectric film for the UAF is disposed below the UAF, and wherein the dielectric film for the UAF includes a via that is aligned at the UAF via land.

5. The inductor article of claim 1, wherein the UAS includes a UAS via land, the inductor article further including:

a dielectric film for the UAS disposed below the UAS, wherein the dielectric or magnetic film for the UAS includes a via that is aligned at the UAS via land.

6. The inductor article of claim 1, wherein the OAF includes an OAF via land, and wherein the UAF includes a UAF via land, the inductor article further including:

a dielectric or magnetic film for the OAF disposed below the OAF, wherein the dielectric film for the OAF includes a via that is aligned at the OAF via land;

a dielectric or magnetic film for the UAF disposed below the UAF, and wherein the dielectric or magnetic film for the UAF includes a via that is aligned at the UAF via land.

7. The inductor article of claim 1, wherein the OAF, the OAS, the UAF, and the UAS form an inductor unit cell, and further including a plurality of unit cells.

8. The inductor article of claim 1, wherein the OAF, the OAS, the UAF, and the UAS form an inductor unit cell, and further including a plurality of unit cells in a range from two to about 500 contiguous, serial unit cells.

9. An inductor article comprising:

an overhand arcuate inductor first section (OAF);

an overhand arcuate inductor subsequent section (OAS) that is electrically coupled to the overhand arcuate inductor first section, wherein the OAF and the OAS occupy the same profile in the X-Y space but a different profile in the Z-dimension;

at least one overhand arcuate inductor intermediate section (OAI) that is disposed between and electrically coupled to the OAF and the OAS;

an underhand arcuate inductor first section (UAF) that is abutting and electrically in contact with the OAS; and an underhand arcuate inductor subsequent section (UAS) that is electrically coupled to the UAF, wherein the UAF and the UAS occupy the same profile in the X-Y space, but a different profile in the Z-dimension;

at least one underhand arcuate intermediate inductor section (UAI) that is disposed between and electrically coupled to the UAF and the UAS.

10. The inductor article of claim 9 , further including:

a plurality of overhand arcuate inductor intermediate sections (OAIs) that are disposed between and electrically coupled to the OAF and the OAS; and a numerically equivalent plurality of underhand arcuate inductor intermediate sections (UAIs) that are disposed between and electrically coupled to the UAF and the UAS.

11. The inductor article of claim 9 , further including:

a plurality of OAIs that are disposed between and electrically coupled to the OAF and the OAS; and a numerically equivalent plurality of UAIs that are disposed between and electrically coupled to the UAF and the UAS, and wherein the plurality is in a range from two to about 500.

12. The inductor article of claim 11, wherein the OAF, the OAIs, the OAS, the UAF, the UAIs, and the UAS form an inductor unit cell, and further including a plurality of unit cells.

13. The inductor article of claim 11, wherein the OAF, the OAIs, the OAS, the UAF, the UAIs, and the UAS form an inductor unit cell, and further including a plurality of unit cells in a range from two to about 333 contiguous, serial unit cells.

14. An article comprising:

a plurality of first abutting insulated electrode coil sub-segments, wherein the plurality of first abutting insulated electrode coil sub-segments occupy the same profile in the X-Y space, but a different profile in the Z-dimension;

a plurality of second abutting insulated electrode coil sub-segments that are contiguous to the plurality of first abutting coil sub-segments, wherein the plurality of second abutting insulated electrode coil sub-segments occupy the same profile in the X-Y space, but a different profile in the Z-dimension, and wherein the first plurality and the second plurality form an helical inductor unit cell.

15. The article of claim 14 wherein the plurality of first abutting insulated electrode coil sub-segments includes:

an overhand arcuate inductor first section (OAF); and an overhand arcuate inductor subsequent section (OAS) that is electrically coupled to the overhand arcuate first inductor section;

wherein the plurality of second abutting insulated electrode coil sub-segments includes:

an UAF that is abutting and electrically in contact with the OAS; and an UAS that is electrically coupled to the UAF.

16. The article of claim 15, wherein the OAF and the UAF have equivalent first thicknesses, wherein the OAS and the UAS have equivalent second thicknesses, and wherein the first thicknesses and the second thicknesses are dissimilar.

17. The article of claim 15, wherein the OAF and the UAF include equivalent first resistivities, wherein the OAS and the UAS have equivalent second resistivities, and wherein the first resistivities and the second resistivities are dissimilar.

18. The article of claim 15, further including:

an overhand arcuate inductor intermediate section (OAI) that is disposed between and electrically coupled to the OAF and the OAS;

an UAI that is disposed between and electrically coupled to the UAF and the UAS.

19. The article of claim 15, further including:

a plurality of OAIs that are disposed between and electrically coupled to the OAF and the OAS; and a numerically equivalent plurality of UAIs that are disposed between and electrically coupled to the UAF and the UAS.

20. The article of claim 15, further including:

a plurality of OAIs that are disposed between and electrically coupled to the OAF and the OAS; and a numerically equivalent plurality of UAIs that are disposed between and electrically coupled to the UAF and the UAS, and wherein the plurality is in a range from two to about 500.

21. The article of claim 20, wherein the OAF, the OAIs, the OAS, the UAF, the UAIs, and the UAS form an inductor unit cell, and further including a plurality of unit cells.

22. A process comprising:

forming an overhand arcuate inductor first section (OAF) on a dielectric;

forming an overhand arcuate inductor subsequent section (OAS) that is electrically coupled to the OAF, wherein the OAF and the OAS occupy the same profile in the X-Y space, but a different profile in the Z-dimension;

forming an underhand arcuate inductor first section (UAF) that is and spaced apart from the OAF and that is electrically in contact with the OAS;

forming a dielectric film over the UAF; and forming an underhand arcuate inductor subsequent section (UAS) that is electrically coupled to the UAF, and wherein the UAF and the UAS occupy the same profile in the X-Y space, but a different profile in the Z-dimension.

23. The process of claim 22, wherein OAF has an OAS via land, and wherein the via and the OAS via land on the OAF are aligned.

24. The process of claim 22, wherein the UAF has a UAS via land, wherein forming the dielectric film over the UAF includes forming a via in the dielectric film over the UAF, and wherein the via and the UAS via land on the UAF are aligned.

25. A package comprising:

a board; and an inductor disposed on the board, wherein the inductor includes:

a plurality of first abutting insulated electrode coil sub-segments, wherein the a plurality of first abutting insulated electrode coil sub-segments occupy the same profile in the X-Y space, but a different profile in the Z-dimension;

a plurality of second abutting insulated electrode coil sub-segments that are contiguous to the plurality of first abutting coil sub-segments, wherein the plurality of second abutting insulated electrode coil sub-segments occupy the same profile in the X-Y space, but a different profile in the Z-dimension, wherein the first plurality and the second plurality form a helical inductor unit cell;

a microelectronic die coupled to the inductor; and dynamic random-access memory coupled to the microelectronic die.

26. The package of claim 25, wherein the system is disposed in one of a computer, a wireless communicator, a hand-held device, an automobile, a locomotive, an aircraft, a watercraft, and a spacecraft.

27. The package of claim 25, wherein the microelectronic die is selected from a data storage device, a digital signal processor, a micro controller, an application specific integrated circuit, and a microprocessor.

* * * * *